United States Patent [19]

Doori

[11] 4,329,778

[45] May 18, 1982

[54] APPARATUS FOR RETAINING A SLIDER

[75] Inventor: Hisashi Doori, Kurobe, Japan

[73] Assignee: Yoshida Kogyo K.K., Toyama, Japan

[21] Appl. No.: 184,027

[22] Filed: Sep. 4, 1980

[30] Foreign Application Priority Data

Sep. 7, 1979 [JP] Japan ..... 54-124217

[51] Int. Cl.[3] ..... B23P 19/04

[52] U.S. Cl. ..... 29/768

[58] Field of Search ..... 29/33.2, 408, 409, 766, 29/768

[56] References Cited

U.S. PATENT DOCUMENTS

| | | | |
|---|---|---|---|
| 3,629,926 | 12/1971 | Maeda | 29/768 |
| 3,685,814 | 8/1972 | Kawakami | 24/205.15 H |
| 3,812,571 | 5/1974 | Doori | 29/768 X |
| 3,844,014 | 10/1974 | Takahashi et al. | 29/768 X |
| 3,844,016 | 10/1974 | Kawakami | 29/768 |
| 3,945,103 | 3/1976 | Fujisaki et al. | 29/408 X |
| 3,956,813 | 5/1976 | Shigeno | 29/768 |
| 3,964,615 | 6/1976 | Silvis et al. | 29/768 X |
| 3,973,312 | 8/1976 | Doori et al. | 29/768 |

*Primary Examiner*—Ervin M. Combs

*Attorney, Agent, or Firm*—Robert E. Burns; Emmanuel J. Lobato; Bruce L. Adams

[57] ABSTRACT

A slide slidably mounted on an arm secured to an indexing plate has a slider seat for supporting thereon a slider body with its pull tab inserted in a slot defined between the slide and the arm. The slider pull tab is immovably held in the slot by a ball mounted in the arm and spring-biased into an aperture in the pull tab. Upon holding of the pull tab, the slide is slightly moved under the resiliency of a spring to lift the slider body until a locking pawl to which the pull tab is connected is withdrawn out of a slider guide channel. A block mounted on a fixed frame contains a spring-biased presser which, upon lateral alignment with the spring-biased ball, forces the ball into locking engagement with the pull tab in the slot, thereby locking the slider for application to a pair of slide fastener stringers.

4 Claims, 6 Drawing Figures

APPARATUS FOR RETAINING A SLIDER

BACKGROUND OF THE INVENTION

1. Field of the Invention

The present invention relates to an apparatus for retaining a slider for application to a pair of slide fastener stringers.

2. Prior Art

An automatic lock slider includes a locking pawl movable into and out of the guide channel in the slider body in response to lifting movement of the pull tab. For threading a slide fastener chain through such a slider, the locking pawl must be withdrawn out of the guide channel in advance so as to allow the chain to pass smoothly through the guide channel. A known slider retainer for supporting automatic lock sliders for application to slide fastener chains comprises a locking prong which, upon insertion of a slider pull tab into the slider retainer, projects into an aperture in the pull tab to hold the slider in position and at the same time to move the pull tab until the locking pawl is retracted out of the slider guide channel. The conventional slider retainer is, however, disadvantageous in that the locking prong tends to hit or abrade the pull tab inserted in the slider retainer thereby damaging or marring the pull tab, or to get damaged when forced into the pull tab aperture.

SUMMARY OF THE INVENTION

A slide having a slider seat is slidably mounted on an arm with a slot defined therebetween for receiving the slider pull tab extending transversely of a slider body. A first means is mounted in the arm for resiliently engaging the slider pull tab in the slot to allow the slider body to rest on the slider seat. A second means is mounted on a block for resiliently coacting with the first means to lock the slider pull tab in the slot. The arm and the block are relatively movable into and out of a position in which the first and second means can coact with each other. The first means comprises a ball disposed in a hole in the arm and a leaf spring normally urging the ball toward the slot. The second means comprises a presser disposed in a hole in the block and a leaf spring normally urging the presser in a direction to press the first-mentioned leaf spring against the ball.

It is an object of the present invention to provide an apparatus for retaining a slide fastener slider without the possibility of marring the slider pull tab.

Another object of the present invention is to provide an apparatus for releasably retaining a slide fastener slider firmly against being displaced or dropping off a slider seat for reliable application to a pair of slide fastener stringers.

Still another object of the present invention is to provide an apparatus for retaining an automatic lock slider with its locking pawl being retracted from the guide channel for easy application to a pair of slide fastener stringers.

Many other advantages, features and additional objects of the present invention will become manifest to those versed in the art upon making reference to the detailed description and the accompanying drawings in which a preferred structural embodiment incorporating the principals of the present invention is shown by way of illustrative example.

DETAILED DESCRIPTION

Figure 1:
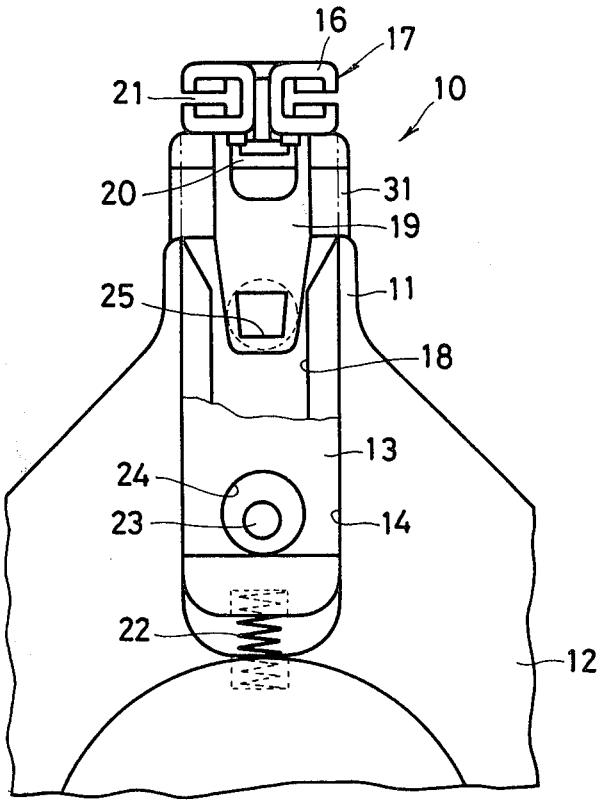
FIG. 1 is a front elevational view of a slider retaining apparatus according to the present invention.
Figure 3:
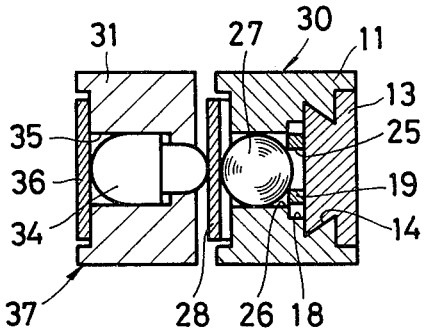
FIG. 3, appearing with FIG. 1, is a cross-sectional view taken along line III—III of FIG. 2.
Figure 2:
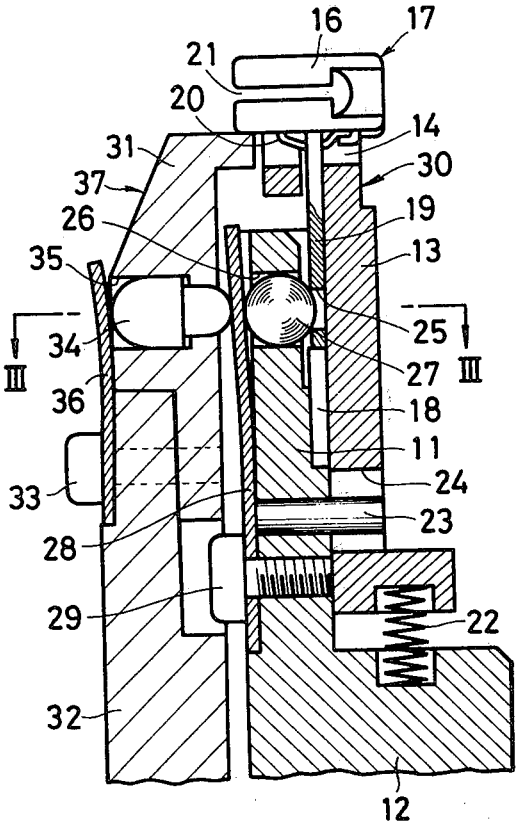
FIG. 2 is a vertical cross-sectional view of the slider retaining apparatus shown in FIG. 1.

The principles of the present invention are particularly useful when embodied in a slider retaining apparatus such as shown in FIGS. 1 through 3, generally indicated by the reference numeral 10.

The slider retaining apparatus 10 comprises an arm 11 projecting radially outwardly from a rotatable plate 12, such as an indexing plate, and an elongate slide 13 slidably fitted in a radial groove 14 in the arm 11 (FIG. 3). The slide 13 has a slider seat 15 for carrying thereon a body 16 of a slide fastener slider 17. There is a radial slot 18 that is defined between the arm 11 and the slide 13 which is receptive of a slider pull tab 19 when the slider body 16 rests on the slider seat 15, as best illustrated in FIG. 2.

The slider 17 is of the automatic locking type as well known in the art that includes a locking spring 20 to which the pull tab 19 is pivotally connected and which has on its distal end a locking pawl 20*a* movable into and out of a guide channel 21 in the slider body 16. The pull tab 19 has an aperture 25 therein.

The slide 13 is normally urged radially outwardly by a compression spring 22 acting between the slide 13 and the plate 12. To limit radial movement of the slide 13, a pin 23 secured to the plate 12 extends into a hole 24 in the slide 13.

A ball 27 is received in part in a hole 26 in the arm 11, which opens into the slot 18. The ball 27 is normally urged toward the slot 18 by a leaf spring 28 held in contact therewith and mounted on the plate 12 by a screw 29. The ball 27 as spring-biased partly enters the aperture 25 (FIGS. 2 and 3) in the slider pull tab 19 when the latter is inserted in the slot 18, and hence acts as a detent for supporting the slider 17 on the slider seat 14. The arm 11 and the slide 13 thus assembled together act as a slider support 30.

As illustrated in FIGS. 2 and 3, a block 31 is mounted on a fixed frame 32 by a screw 33. A pressure 34 is movably disposed in a through hole 35 in the block 31. The block 31 is positioned in lateral alignment with the slider support 30 when the latter has been brought into a position where the slider supported thereon is to be applied to slide fastener stringers. A leaf spring 36 is fixed by the screw 33 to the frame 32 and normally urges the presser 34 into pressing engagement with the leaf spring 28 of the slider support 30 as located in the slider-applying position. The spring-biased presser 34 acts as a slider locker 37.

The resiliency of the spring 34 is stronger than that of the spring 28, which is stronger than the resiliency of the spring 22. The spring 22 is stronger in resiliency than the locking spring 20 in the slider 17. The resiliencies of the springs 20,22 and 28 are selected such that when the slider pull tab 19 is loaded in the slot 18 and the spring-biased ball 27 is seated in the aperture 25, the pull tab 19 is immovably held in the slot 18 and the slide 13 is urged by the spring 22 to lift the slider body 16 until the locking pawl 20*a* is withdrawn out of the slider guide channel 21.

Figure 4:
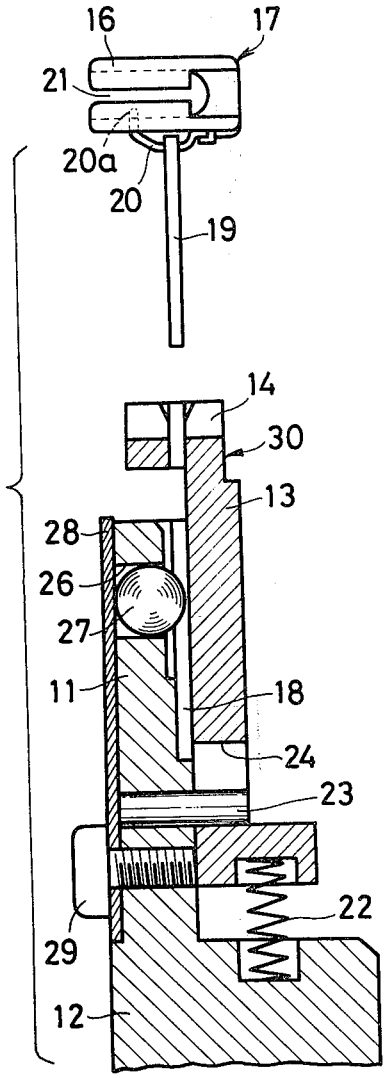
FIGS. 4 through 6 are vertical cross-sectional views illustrative of progressive steps of supporting a slider on a slider support in the slider retaining apparatus.
Figure 5:
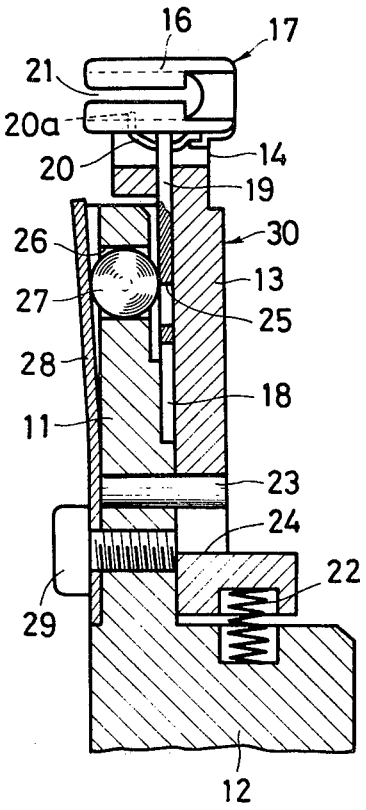
Figure 6:
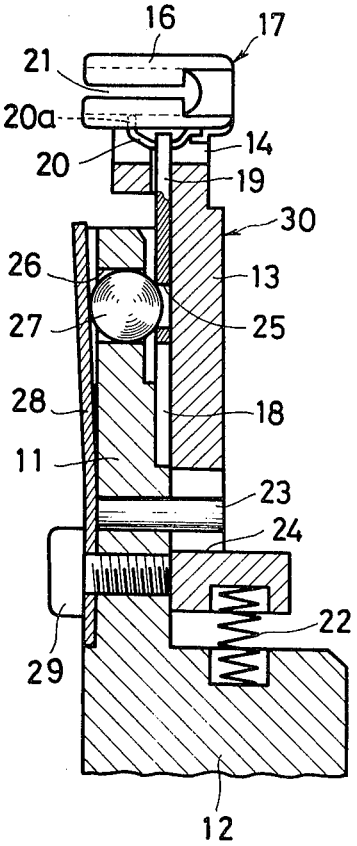

Operation of the slider retaining apparatus 10 is as follows: As shown in FIG. 4, the pull tab 19 is erected from its recumbent position on the slider body 16 so as to be substantially perpendicularly to the slider body 16 and directed toward the slot 18. The pull tab 19 is then inserted into the slot 18 until the slider body 16 rests on the seat 14. The slider 17 is further pushed to cause the slide 13 to be slid radially inwardly until one end of the hole 24 is engaged by the pin 23 against the force of the spring 22 as illustrated in FIG. 5. At this time, the aperture 25 in the slider pull tab 19 has moved slightly past the ball 27. Then, the slider 17 is released of the push to allow the slide 13 to be slightly returned under the force of the spring 22 until the ball 27 partly enters into the apertures 25 in the pull tab 19 under the force of the spring 28 (FIG. 6). The pull tab 19 is supported immovably on the arm 11 due to pressing engagement of the ball 27 with the pull tab 19. The slide 13 is further backed off radially outwardly under the resiliency of the spring 22 to cause the slider body 16 on the seat 14 to be raised with respect to the pull tab 19, so that the locking pawl 20*a* is withdrawn out of the slider guide channel 21 as illustrated in FIG. 6.

Such slider loading is effected when the slider support 30 is located away from the slider locker 37, or preferably in a position angularly spaced 90 degrees from the slider locker 37. Since the spring 28 is relatively weak, the ball 27 does not damage or mar the pull tab 19 while in contact therewith.

The indexing plate 12 is now angularly moved preferably through 90 degrees counterclockwise in FIG. 1 until the slider support 30 is brought into lateral alignment with the slider locker 37 as shown in FIGS. 2 and 3, whereupon the presser 34 is pressed under the force of the leaf spring 36 against the leaf spring 28 to force the ball 27 into the aperture 25 in the pull tab 19, thereby locking the pull tab 19 firmly in the slot 18. The slider 17 is now ready for application to a pair of slide fastener stringers (not shown), which can be threaded through the slider 17 without being caught by the locking pawl 20*a* that has been retracted out of the guide channel 21.

After threading of the slide fastener stringers through the slider 17, the indexing plate 12 is angularly moved again preferably through 90 degrees in the counterclockwise direction in FIG. 1 to permit the leaf spring 28 to disengage from the spring-biased presser 34. The slider pull tab 19 is now held in the slider support 30 only by engagement with the spring-biased ball 27, and hence the slider 17 can easily be dislodged from the slider support 30 with a relatively small force.

While the slider support 30 has been shown and described as being angularly movable, it may be vertically, horizontally or otherwise movable provided the slider support 30 and the slider locker 37 are relatively movable for coaction with each other to lock the slider pull tab 19 in the slot 18. As an alternative, the slider locker 37 may be movable and the slider support 30 may be fixed for such relative locking movement.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. An apparatus for retaining a slider having a body and an apertured pull tab pivotally connected to the body in a position for application to a pair of slide fastener stringers, said apparatus comprising:

(a) an arm;

(b) a slide slidably mounted on said arm and having a seat for supporting the slider body thereon, there being a slot defined between said arm and said slide for receiving therein the slider pull tab as extending transversely of the slider body;

(c) first means in said arm for resiliently engaging the slider pull tab inserted in said slot to allow the slider body to rest on said slider seat;

(d) a block; and (e) second means in said block for resiliently coacting with said first means to lock the slider pull tab in said slot, said arm and said block being relatively movable into and out of a position in which said first and second means can coact with each other.

2. An apparatus according to claim 1, including a fixed frame to which said block is secured, a movable plate to which said arm is secured, a spring acting between said slide and said movable plate and normally urging said slide in a direction to pull the pull tab out of said slot, said slide having a hole, and a pin fixed to said movable plate and extending into said hole for limiting movement of said slide under the resiliency of said spring.

3. An apparatus according to claim 1, said arm having a hole opening into said slot, said first means comprising a ball disposed in said hole and engageable in an aperture in the pull tab, and a first leaf spring normally urging said ball toward said slot.

4. An apparatus according to claim 3, said block having a through hole, said second means comprising a presser disposed in said through hole and a second leaf spring mounted on said block and normally urging said presser in a direction to press said first leaf spring upon coaction between said first and second means.

* * * * *